US005800126A

United States Patent [19]

Tsai

[11] Patent Number: 5,800,126

[45] Date of Patent: Sep. 1, 1998

[54] SWINGING HEAD GEAR SHELL OF AN ELECTRIC FAN

[76] Inventor: Ching-Lang Tsai, No. 1, Lane 210, Section 1, Chu-Shih Rd., Lung-Chin Hsiang, Taichung County, Taiwan

[21] Appl. No.: 761,361

[22] Filed: Dec. 9, 1996

[51] Int. Cl.[6] ..... F04D 25/10

[52] U.S. Cl. ..... 416/100; 416/98; 416/108; 416/169 R; 416/170 R; 74/425; 74/606 R

[58] Field of Search ..... 416/100, 108, 416/110, 98, 169 R, 170 R, 247 R; 74/89.14, 425, 606 R

[56] References Cited

U.S. PATENT DOCUMENTS

| | | | |
|---|---|---|---|
| 863,556 | 8/1907 | Priest et al. | 74/606 R |
| 2,253,127 | 8/1941 | Koch | 416/100 |
| 3,625,633 | 12/1971 | Nelson | 416/100 |
| 5,584,207 | 12/1996 | Paul et al. | 74/606 R |

FOREIGN PATENT DOCUMENTS

| | | | |
|---|---|---|---|
| 0290926 | 12/1931 | Italy | 416/100 |
| 0162790 | 7/1987 | Japan | 416/100 |

*Primary Examiner*—Christopher Verdier
*Attorney, Agent, or Firm*—Morton J. Rosenberg; David I. Klein; Jun Y. Lee

[57] ABSTRACT

A swinging head gear shell for an electric fan is provided and includes a body and a cover respectively molded from reinforced engineering plastics. The body has a mounting plate for mounting with screws, a first open top chamber and a second open top chamber linked in parallel and adapted for receiving a swinging head gear. The body has a plurality of screw holes for the mounting of the cover, and a vertical locating barrel through which one gear shaft of the swinging head gear passes. The mounting plate has a circular through hole through which the worm of the swinging head gear passes. The cover overlays the body to close the first open top chamber and the second open top chamber, and has a plurality of mounting holes respectively fastened to the top screw holes of the body by screws. The cover has a raised portion, and a through hole formed in the raised portion in communication with the second open top chamber for the control lever of the swinging head gear to pass.

2 Claims, 6 Drawing Sheets

SWINGING HEAD GEAR SHELL OF AN ELECTRIC FAN

BACKGROUND OF THE INVENTION

The present invention relates to a shell of a swinging head gear of an electric fan, and more particularly to such a shell which is durable, heat-resistant, wear-resistant, easy to maintain, and inexpensive to manufacture.

FIG. 5 shows a shell of a swinging head gear for an electric fan according to the prior art. The shell 1 is made of a zinc-aluminum alloy or an aluminum alloy by a casting process. The control lever 6 directly extends out from a hole in the shell 1. That structure of a swinging head gear shell has drawbacks. Because the control lever 6 extends directly out from the shell 1, a reactive stress is produced and borne at the shell 1 when the gears of the head are turned. Therefore, the shell 1 tends to be damaged. Because the shell 1 is made of a zinc-aluminum alloy or aluminum alloy, its manufacturing cost is high, and heat will be quickly transmitted from the fan motor to the swinging head gear through the shell 1, causing the lubricating grease of the swinging head gear to melt and to dirty the swinging head of the electric fan. Furthermore, because the shell 1 is made from metal, electricity will be transmitted to the shell 1 if there is an electric leakage at the fan motor.

SUMMARY OF THE INVENTION

The present invention has been accomplished to provide a swinging head gear shell which eliminates the aforesaid drawbacks. It is one object of the present invention to provide a swinging head gear shell which is molded from reinforced engineering plastics. It is another object of the present invention to provide a swinging head gear shell which is heat resistant, and durable. It is still another object of the present invention to provide a swinging head gear shell which is inexpensive to manufacture. According to the present invention, the swinging head gear shell comprises a body and a cover respectively molded from reinforced engineering plastics. The body comprises a mounting plate vertically disposed at one side, a first open top chamber and a second open top chamber linked in parallel, a first vertical locating barrel and a second vertical locating barrel respectively extended from the first open top chamber and the second open top chamber from a bottom side, and a plurality of top screw holes at the border. The mounting plate is fastened through a plurality of horizontal mounting holes to a locating plate behind the fan motor by screws. The mounting plate has a circular through hole disposed in communication with the first open top chamber. The cover is overlayed on the body to close the first open top chamber and the second open top chamber. The cover has a plurality of mounting holes respectively fastened to the body through the top screw holes of the body by screws. The cover also has a raised portion, and a through hole formed in the raised portion, in communication with the second open top chamber. The first open top chamber is adapted for receiving a first gear having a gear shaft extending out from a first locating barrel and connected to a fan motor housing through a crank. The circular through hole of the mounting plate is adapted for receiving a worm, permitting it to be inserted into the first open top chamber above the first gear. The second open top chamber is adapted for receiving a second gear and a third gear and a control lever, permitting the second gear to be forced into engagement with the worm, the third gear to be mounted on the control lever and meshed with the first gear, and the control lever to be extended out of the through hole of the cover for controlling the engagement between the second gear and the worm.

DETAILED DESCRIPTION OF THE PREFERRED EMBODIMENT

Figure 1:
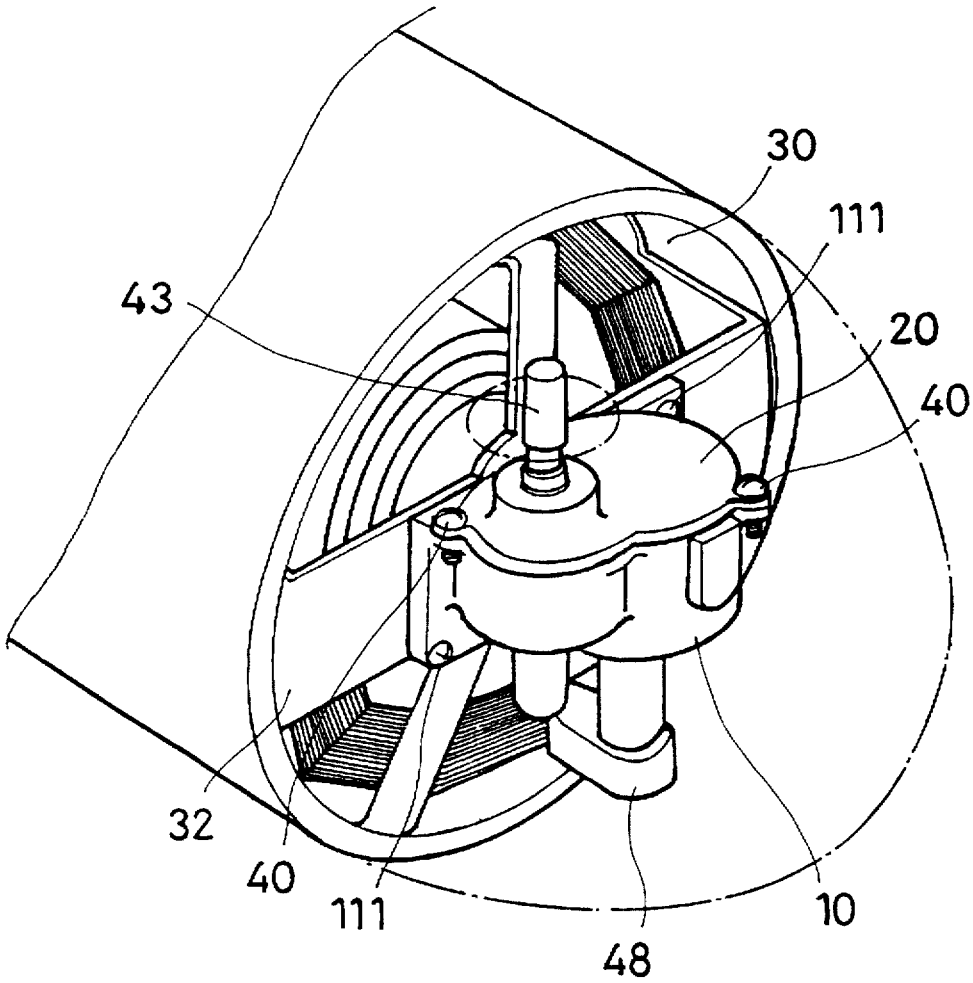
FIG. 1 shows a swinging head gear shell installed in a swinging head of an electric fan.
Figure 3:
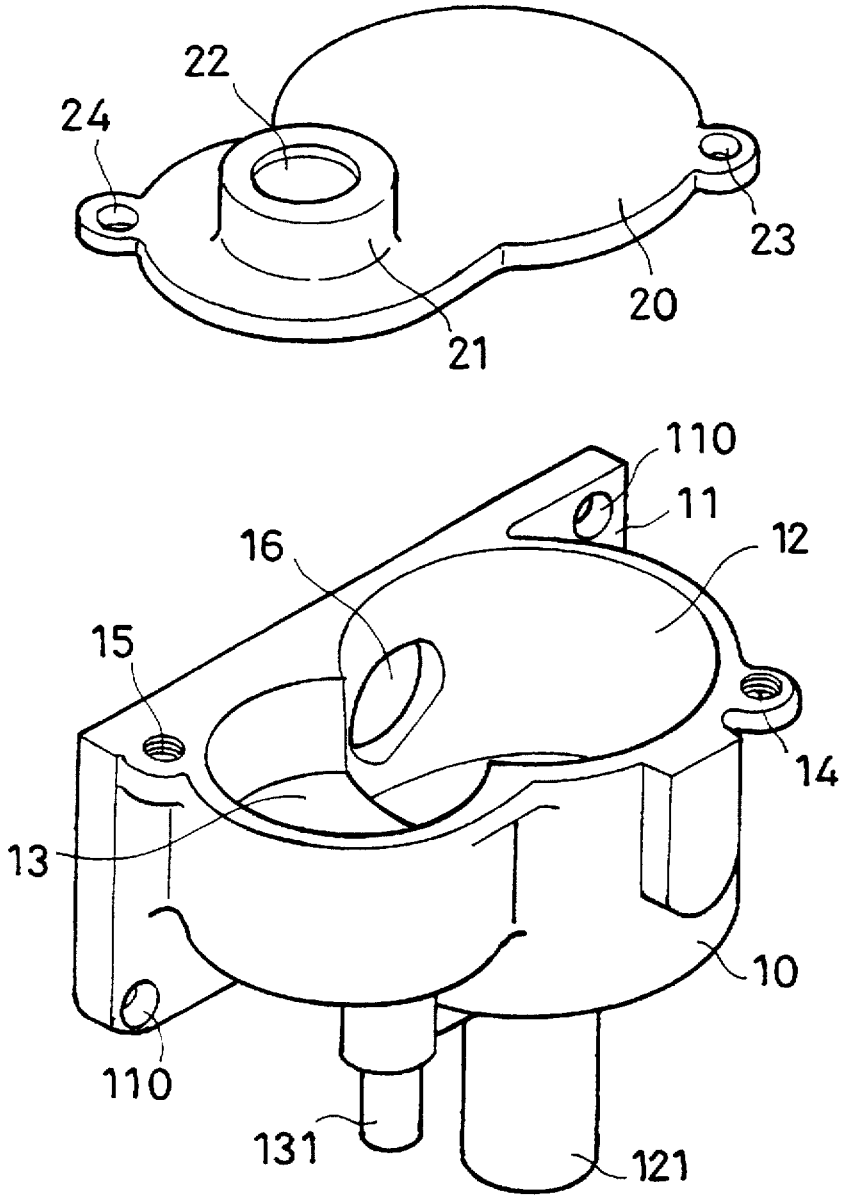
FIG. 3 is an exploded view in an enlarged scale of the swinging head gear shell shown in FIG. 1.

Referring to FIGS. 1 and 3, a swinging head gear shell is mounted behind a fan motor 30, and includes a body 10 and a cover 20. The body 10 comprises a mounting plate 11 vertically disposed at one side, a first open top chamber 12 and a second open top chamber 13 linked in parallel. The body 10 further includes a first vertical locating barrel 121 and a second vertical locating barrel 131 respectively extending from the bottom of the first open top chamber 12 and the bottom of the second open top chamber 13, and a plurality of screw holes 14, 15 at the top of the border. The first open top chamber 12 is relatively deeper than the second open top chamber 13. The mounting plate 11 has a plurality of horizontal mounting holes 110 respectively fastened to a locating plate 32 at the back side of the fan motor 30 by screws 111, and a circular through hole 16 disposed in communication with the first open top chamber 12. The cover 20 overlays the body 10 to close the first open top chamber 12 and the second open top chamber 13, and has a plurality of mounting holes 23, 24 respectively fastened to the top screw holes 14, 15 of the body 10 by screws 40. The cover 20 has a raised portion 21, and a through hole 22 formed in the raised portion 21 in communication with the second open top chamber 13.

Figure 2A:
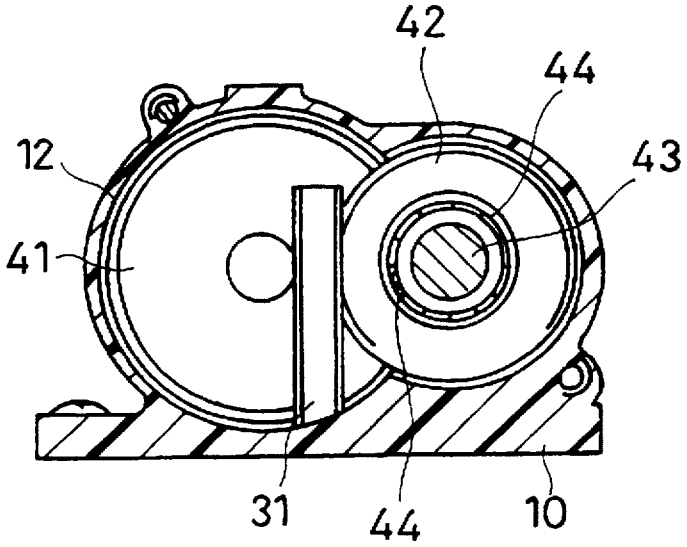
FIG. 2A is a top sectional view of the swinging head gear shell shown in FIG. 1.
Figure 2C:
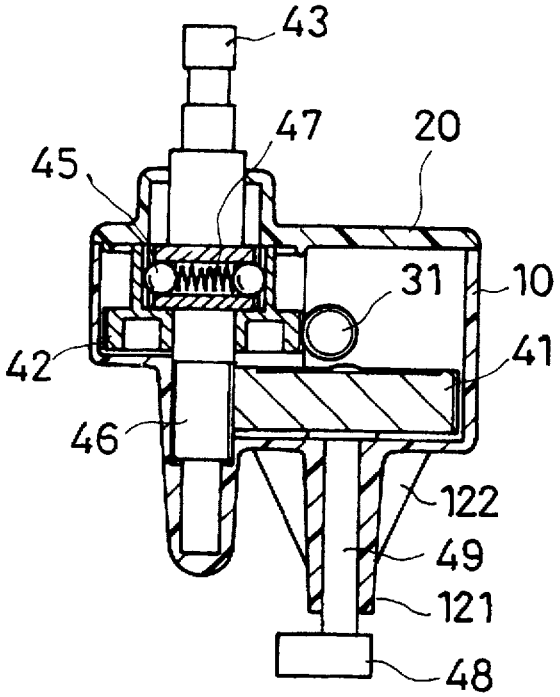
FIG. 2C is a side sectional view of the swinging head gear shell of FIG. 1 showing the control rod engaged with the second gear.
Figure 2B:
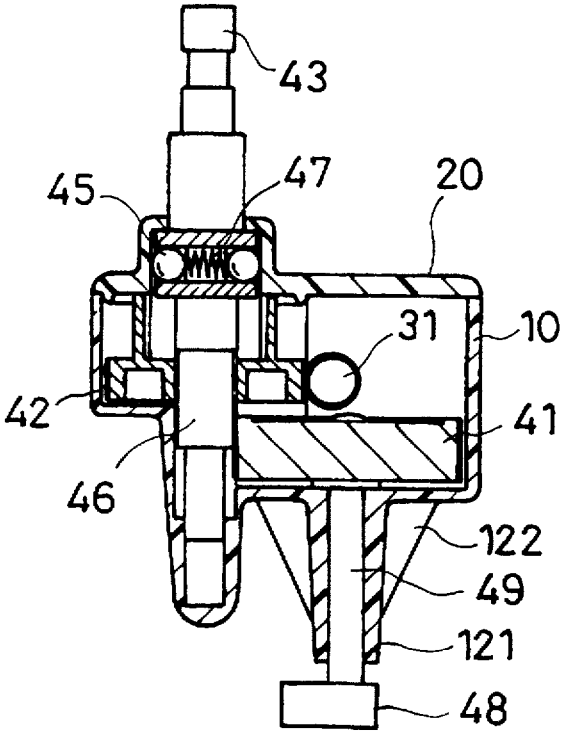
FIG. 2B is a side sectional view of the swinging head gear shell of FIG. 1 showing the control rod disengaged from the second gear.

Referring additionally to FIGS. 2A and 2B, a worm gear 31 that is driven by the fan motor is inserted through the circular through hole 16 of the mounting plate 11 into the first open top chamber 12. A first gear 41 is mounted within the first open top chamber 12 below the worm gear 31, a second gear 42 is mounted around a control rod 43 within the second open top chamber 13 and meshed with the worm gear 31, a third gear 46 is mounted on the control rod 43 at the bottom side thereof, within the first open top chamber 12 and meshed with the first gear 41. The control rod 43 has a top end extending out from the through hole 22 of the cover 20, and is movable vertically between a first position (FIG. 2C) in which steel balls 45 are forced outwards into engagement with the recesses 44 of the second gear 42 by spring means 47, and a second position (FIG. 2B) in which steel balls 45 are released from the recesses 44 of the second gear 42. A crank 48 is disposed outside the first locating barrel 121, and coupled between the gear shaft 49 of the first gear 41 and the housing of the fan motor 30 by conventional linkage. By means of shifting the control lever 43 between the first position and the second position, the fan motor 30 is retained in position or oscillated back and forth within a limited angle.

The body 10 and the cover 20 are preferably molded from reinforced engineering plastics (for example, nylon fiber reinforced plastic) for the advantages of high fluidity, high heat-resistant and wear-resistant power, and low material cost. If the body 10 and the cover 20 have a burr, the burr can be easily removed by a cutting tool or by hand.

Figure 4:
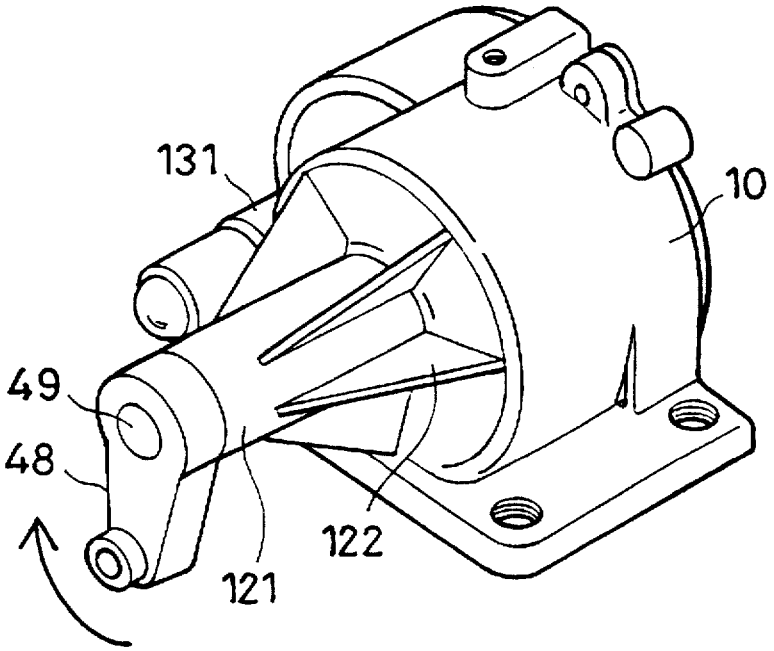
FIG. 4 is an elevational view of the swinging head gear shell shown in FIG. 1.
Figure 5:
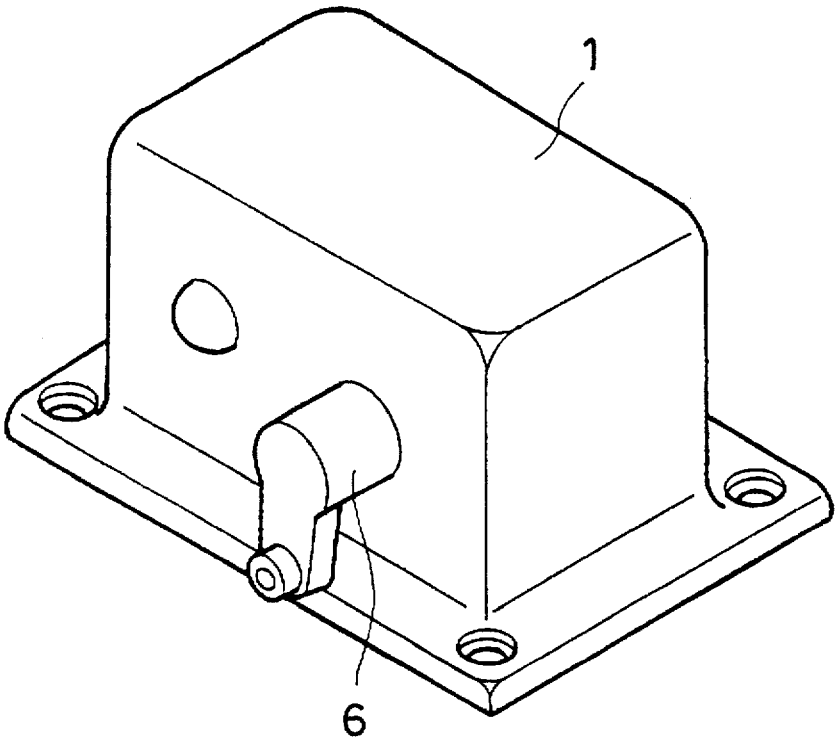
FIG.5 PRIOR ART
FIG. 5 is a swinging head gear shell according to the prior art.

Referring to FIG. 4, reinforcing ribs 122 are raised around the periphery of the first locating barrel 121 and extend to the bottom side of the body 10 to reinforce the structural strength of the first locating barrel 121 against reaction stress resulting from the operation of the first gear 41 and the second gear 42.

What the invention claimed is:

1. A swinging head gear shell for a swinging head electric fan having a fan motor comprising a body and a cover respectively molded from reinforced engineering plastic, said body including (1) a mounting plate vertically disposed at one side of said body, (2) a first open top chamber, (3) a second open top chamber disposed in parallel with said first open top chamber, (4) a first vertical locating barrel extending from a bottom side of said first open top chamber, (5) a second vertical locating barrel extending from a bottom side of said second open top chamber, and (6) a plurality of screw holes formed in a top border portion of said body, said mounting plate having a plurality of horizontal mounting holes formed therethrough and being respectively fastened to a locating plate disposed behind the fan motor by screws secured through said horizontal mounting holes, said mounting plate having formed therein a circular through hole disposed in communication with said first open top chamber, said cover overlaying said body to close said first open top chamber and said second open top chamber, said cover having (1) a plurality of mounting holes formed therethrough in aligned relationship with said screw holes of said body for coupling of said cover by screws extending therethrough, (2) a raised portion, and (3) a through hole formed in said raised portion in communication with said second open top chamber, said first open top chamber receiving a first gear therein, said first gear having a gear shaft extending out from said first locating barrel for connection to a fan motor housing through a crank, said first open top chamber having space above said first gear into which a worm gear extends, said worm gear extending through said circular through hole of said mounting plate, said second open top chamber receiving a second gear meshingly engaged with said worm gear and a third gear and a control rod, said third gear being coupled to said control rod and meshingly engaged with said first gear, said control rod extending out from said through hole of said cover, said second open top chamber receiving means for coupling said second gear to said control rod responsive to a longitudinal displacement of said control rod to thereby rotatable drive said first gear and the crank therewith.

2. The swinging head gear shell of claim 1 further comprising a plurality of reinforcing ribs connected between an outer surface of said first locating barrel and a respective portion of said bottom side of said first open top chamber.

* * * * *